US008215915B2

(12) United States Patent
Souers et al.

(10) Patent No.: US 8,215,915 B2
(45) Date of Patent: Jul. 10, 2012

(54) BLADE CLOSING KEY SYSTEM FOR A TURBINE ENGINE

(75) Inventors: Philip F. Souers, Chuluota, FL (US); Mahmood K. Silieti, Orlando, FL (US); Somesh J. Ghunakikar, Orlando, FL (US); James A. Chonody, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 470 days.

(21) Appl. No.: 12/466,924

(22) Filed: May 15, 2009

(65) Prior Publication Data

US 2010/0290914 A1 Nov. 18, 2010

(51) Int. Cl.
*F01D 5/32* (2006.01)

(52) U.S. Cl. ..... 416/221; 415/170.1

(58) Field of Classification Search ..... 416/219–222; 415/170.1, 173.4

See application file for complete search history.

(56) References Cited

U.S. PATENT DOCUMENTS

| | | | | |
|---|---|---|---|---|
| 2,971,743 | A | 2/1961 | Welsh | |
| 2,971,744 | A | 2/1961 | Szydlowski | |
| 3,076,634 | A | 2/1963 | Boyle et al. | |
| 3,353,788 | A | 11/1967 | Weeds | |
| 3,383,095 | A | 5/1968 | Anderson | |
| 3,653,781 | A | 4/1972 | Cooper | |
| 3,761,200 | A | 9/1973 | Gardiner | |
| 3,801,222 | A | 4/1974 | Violette | |
| 3,986,779 | A | 10/1976 | Beckershoff | |
| 4,349,318 | A * | 9/1982 | Libertini et al. | 416/220 R |
| 4,478,554 | A | 10/1984 | Surdi | |
| 4,527,952 | A | 7/1985 | Forestier et al. | |
| 4,915,587 | A | 4/1990 | Pisz et al. | |
| 5,228,835 | A | 7/1993 | Chlus | |
| 5,318,405 | A * | 6/1994 | Meade et al. | 416/220 R |
| 5,622,476 | A | 4/1997 | Adde et al. | |
| 6,042,336 | A * | 3/2000 | Bulgrin et al. | 416/145 |
| 6,109,877 | A | 8/2000 | Gekht et al. | |
| 6,494,684 | B1 | 12/2002 | Wagner | |
| 7,048,508 | B2 | 5/2006 | Bachofner et al. | |
| 7,334,331 | B2 * | 2/2008 | Bouchard et al. | 29/889.23 |
| 7,410,345 | B2 * | 8/2008 | Bracken | 416/215 |
| 7,484,936 | B2 * | 2/2009 | Bouchard et al. | 416/193 R |
| 7,997,860 | B2 * | 8/2011 | Burdgick et al. | 415/191 |
| 2003/0180143 | A1 * | 9/2003 | Um et al. | 415/173.1 |
| 2007/0258816 | A1 * | 11/2007 | Bouchard et al. | 416/193 A |

* cited by examiner

*Primary Examiner* — Nathan Ha

(57) ABSTRACT

A blade closing key system includes a first key piece and a second key piece. The first key piece includes a first finger and an elongated alignment plate. The second key piece includes a second finger and a key slot. The key pieces are installed in a cavity collectively formed by a notch in a blade root and a slot in a rotor disc. The first and second fingers are bent toward each other and engage each other at their ends. Simultaneously, at least a portion of the alignment plate is received in the key slot. During engine operation, the engagement between the alignment plate and the key slot keeps the first and second key pieces aligned. Thus, regardless of the width of either of the two key pieces or the width of the cavity, the fingers remain constantly engaged during engine operation, minimizing the potential for blade liberation.

20 Claims, 5 Drawing Sheets

BLADE CLOSING KEY SYSTEM FOR A TURBINE ENGINE

FIELD OF THE INVENTION

The invention relates in general to turbine engines and, more particularly, to blades in a turbine engine.

BACKGROUND OF THE INVENTION

The compressor section of a gas turbine engine inducts air and compresses it through alternating rows of stationary vanes and rows of rotating blades. Each row of blades is formed by a plurality of blades attached in a circumferential array to a rotor disc.

Referring to FIG. 1, each compressor blade 10 is comprised of an airfoil 12 and a root 14. The root 14 can be configured to be slidably received into a respective axial groove 16 in a compressor disc 18. The root 14 and the groove 16 can be configured for interlocking engagement. As is shown in FIG. 1, at least a portion of the root 14 is configured as a male dovetail, and at least a portion of the groove 16 is configured as a corresponding female dovetail. As a result of such an arrangement, movement of the blade 10 is restrained by the groove 16 of the disc 18 in the radial and circumferential directions relative to the axis of rotation of the disc. However, restraint of the blade 10 in the axial direction, sometimes referred to as locking, requires a separate device.

Locking in the axial direction has been achieved by using a blade closing key 20 in connection with one or more of the blades in the row. In some instances, a closing key may be used only in connection with the last blade installed in the row. To accommodate the blade closing key 20, a notch 22 is provided in an upper portion of each blade root 14 and a circumferential slot 24 is provided about a portion of the rotor disc 18. When the blade 10 is inserted in the disc 18, the slot 24 and the notch 22 are aligned and collectively define a cavity 26 to receive the closing key 20. The cavity 26 is closed at one circumferential end by the notch 22 in the blade root 14. The cavity 26 is closed at its opposite circumferential end by a portion of the root of a neighboring blade (not shown). The closing key 20 is received in the cavity 26.

Referring to FIG. 2, one known closing key 20' is a two piece construction that has a first key piece 28 (also called a tail piece) and a second key piece 30 (also referred to a head piece). The first key piece 28 has a base body 32 with a first straight finger 34 protruding from a first side surface 36 thereof. Likewise, the second key piece 30 has a base body 38 with a second straight finger 40 protruding from a second side surface 42 thereof. The second key piece 30 includes a tab 44 adapted to be received in the notch 22 in the blade root 14. Each of the base bodies 32, 38 have a cross-sectional shape adapted for interlocking engagement with the cavity 26. For example, the base bodies 32, 38 have been configured as male dovetails for interlocking engagement with the cavity 26.

To install the closing key 20' in the cavity 26, the first key piece 28 is initially inserted in the cavity 26 and then the second key piece 30. Once in the cavity 26, the first and second key pieces 28, 30 are collapsed, that is, the first and second key pieces 28, 30 are brought together so that the end of the first finger 34 substantially abuts the second side surface 42 of the base body 38 of the second piece 30 and so that the end of the second finger 40 substantially abuts the first side surface 36 of the base body 32 of the first piece 28. In such case, the first and second fingers 34, 40 will be generally parallel to each other along their lengths. Further, in order to lock the blade 10, the first and second key pieces 28, 30 are moved away from each other such that the tab 44 of the second key piece 30 is moved in the notch 22 of the blade root 14 to lock the blade 10. The ends of the fingers 34, 40 are brought into operative engagement with each other. In doing so, the fingers 34, 40 bend, as is shown in FIG. 3. This expanded length of the closing key 20' is held fixed by the opposing bending forces exerted by each of the pieces 28, 30.

However, in certain circumstances, the first and second key pieces 28, 30 may be able to rotate within the cavity 26. Such rotation, which is sometimes referred to as window cocking, may arise for any of a number of reasons. For instance, rotation of the first and second key pieces 28, 30 can be due to machining tolerances in forming the first and second key pieces 28, 30 and/or the cavity 26. Alternatively or in addition, rotation of the first and second key pieces 28, 30 can arise if there is a decrease in the width of the first and second key pieces 28, 30 and/or if the width of the cavity 26 increases. Such changes in width can be due to wear and/or corrosion.

If one or both of the key pieces 28, 30 rotates a sufficient amount, then the fingers 34, 40 may no longer oppose one another and become disengaged so that the fingers 34, 40 slide past each other. In such case, the opportunity is provided for the first and second key pieces to move toward each other, which shortens their combined length, similar to when the pieces 28, 30 are collapsed to facilitate installation. When this happens, it is possible for the tab 44 to move out of the blade notch 22, allowing the blade 10 to become unlocked, that is, the blade 10 is permitted to move axially within the groove 16 in the compressor disc 18. If the blade 10 becomes liberated, it can cause significant damage to other components in the compressor and can force engine shutdown.

Thus, there is a need for a closing key configured to minimize such concerns.

SUMMARY OF THE INVENTION

In one respect, aspects of the invention are directed to a blade closing key system. The system includes a first key piece and a second key piece.

The first key piece has a base body with a first finger protruding from a first side surface of the base body. The first finger is substantially straight and is bendable. The first straight finger has a first end.

The first key piece further includes an alignment plate that extends from the first side surface. The first finger and/or the alignment plate can extend from the first side surface at about 90 degrees. The first finger and the alignment plate can be substantially parallel. The alignment plate can be substantially straight. The alignment plate can have an inner surface, and the base body of the first key piece can have an inner surface. The inner surface of the alignment plate can be substantially flush with inner surface of the base body of the first key piece.

The alignment plate is spaced from the first finger. The alignment plate can be disposed at a lower radial elevation than the first finger. The alignment plate can have an associated length, and the first finger can have an associated length. The length of the alignment plate can be greater than the length of the first finger. In one embodiment, the length of the alignment plate can be about two to about three times greater than the length of the first finger.

The second key piece can have a base body with a second finger protruding from a first side surface of the base body. The second finger is substantially straight and is bendable. The second finger has a second end. The second key piece further includes a key slot sized to receive the alignment plate.

The key slot has an open first longitudinal end. The key slot can also include an open second longitudinal end.

The first and second key pieces are positioned such that at least a portion of the alignment plate is received in the open first longitudinal end of the key slot and such that first and second fingers are opposed in bending with the first and second ends engaging each other. Thus, the engagement between the alignment plate and the key slot keeps the first and second key pieces aligned and the first and second fingers engaged. The alignment plate and the key slot can be in substantially mating engagement.

The key slot can open to an inner surface of the base body of the second key piece. The alignment plate can have an inner surface, and the base body of the second key piece can have an inner surface. The inner surface of the alignment plate can be substantially flush with inner surface of the base body of the second key piece.

Another blade closing key system according to aspects of the invention includes a blade and a rotor disc. The blade has an airfoil and a root. A notch is provided in the root. The rotor disc can be a compressor rotor disc. The rotor disc has a circumferentially extending slot. The rotor disc also has a groove configured to receive at least a portion of a blade root. The root of the blade is received in the groove so as to attach the blade to the disc and so as to restrain movement of the blade in radial and circumferential directions relative to an axis of rotation of the rotor disc. The notch in the blade is substantially aligned with the slot in the disc to collectively define a cavity.

A closing key is received in the cavity. The closing key restrains movement of the blade in the axial direction. The closing key includes a first key piece and a second key piece.

The first key piece has a base body with a first finger protruding from a first side surface of the base body. The first finger is substantially straight and is bendable. The first finger has a first end. The first key piece further includes an alignment plate that extends from the first side surface. The alignment plate is spaced from the first finger. The first finger and the alignment plate can be substantially parallel.

The alignment plate can have an associated length and the first finger can have an associated length. The length of the alignment plate can be greater than the length of the first finger. The alignment plate can have an inner surface, and the base body of the first key piece can have an inner surface. The inner surface of the alignment plate can be substantially flush with inner surface of the base body of the first key piece.

The second key piece has a base body with a second finger protruding from a first side surface of the base body. The second finger is substantially straight and is bendable. The second straight finger has a second end. The second key piece further includes a key slot sized to receive the alignment plate. The key slot has an open first longitudinal end. The key slot can further include an open second longitudinal end. The key slot can open to the inner surface of the base body of the second key piece.

The first and second key pieces are positioned such that at least a portion of the alignment plate is received in the key slot through the open first end and such that first and second fingers are opposed in bending with the first and second ends engaging each other. The engagement between the alignment plate and the key slot keeps the first and second key pieces aligned and the first and second fingers engaged. The alignment plate and the key slot can be in substantially mating engagement.

DETAILED DESCRIPTION OF THE INVENTION

Embodiments of the invention are directed to a blade closing key system, which can improve the reliability of the closing keys. Aspects of the invention will be explained in connection with various possible closing key configurations and in the context of compressor blades, but the detailed description is intended only as exemplary. Embodiments of the invention are shown in FIGS. 4-8, but the present invention is not limited to the illustrated structure or application.

Figure 4:
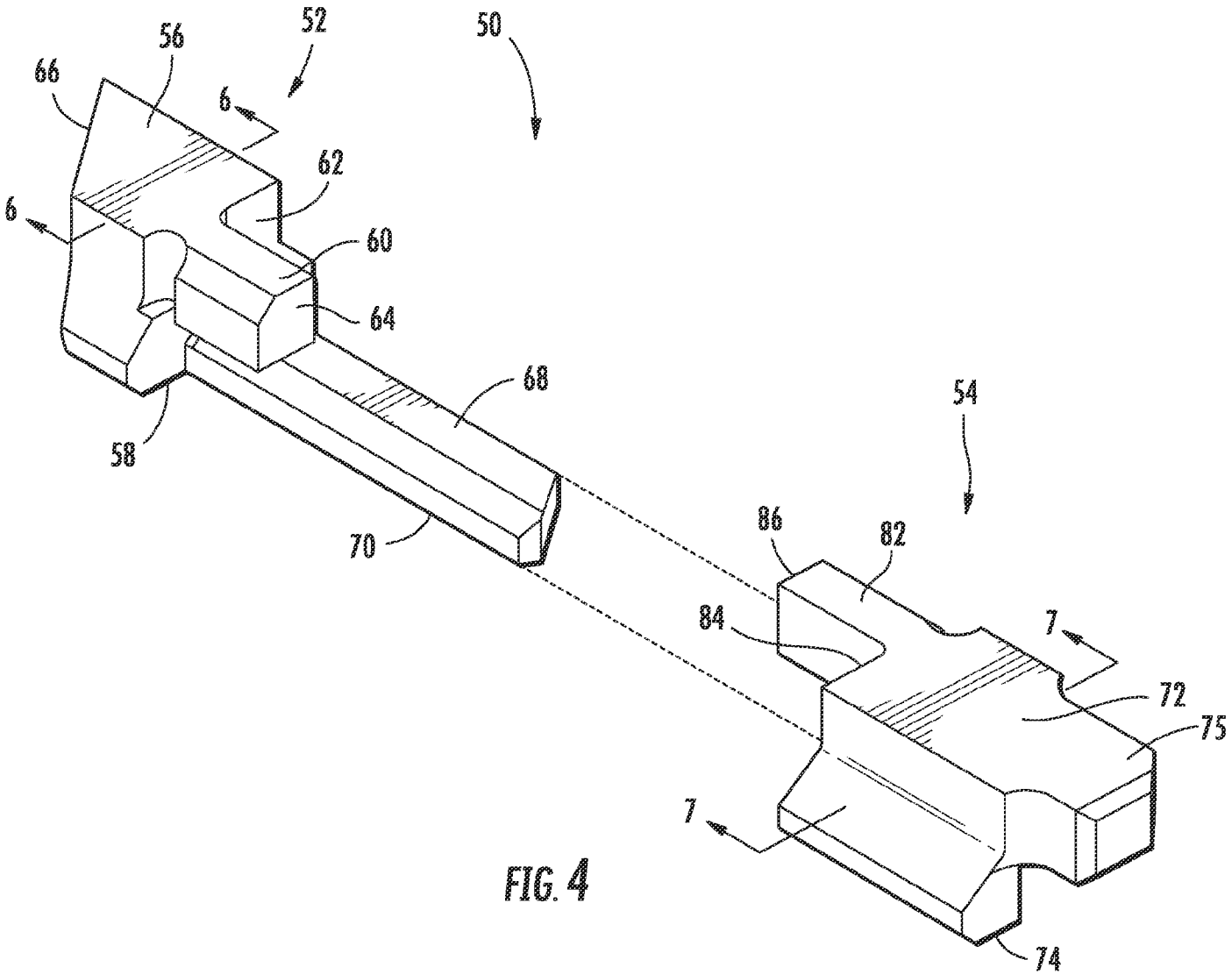
FIG. 4 is perspective exploded view of a closing key system according to aspects of the invention.

Referring to FIG. 4, a closing key system 50 according to aspects of the invention includes a first key piece 52 (or tail piece) and a second key piece 54 (or head piece). The first and second key pieces 52, 54 are equipped with features according to aspects of the invention to ensure that they remain operatively engaged during engine operation. At the outset, it is noted that the closing key system according to aspects of the invention would not require modification to the slot 24 in the compressor disc 18 or the notch 22 in the blade root 14 in at least some of the known closing key systems. Accordingly, reference numbers for the blade 10 and disc 18 and their associated features, as used above, will be used herein for the same structure.

Figure 6:
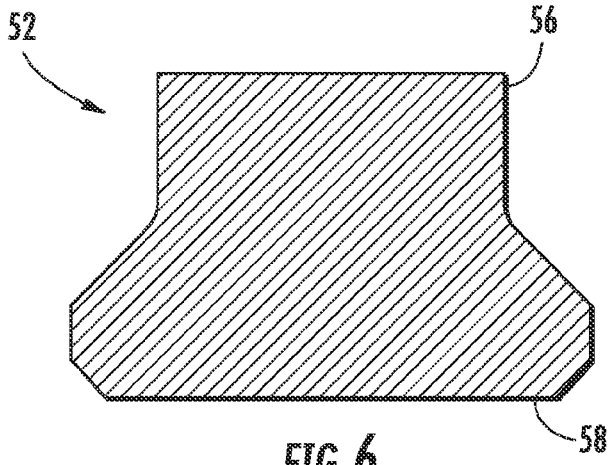
FIG. 6 is a cross-sectional view of a first piece of a closing key system according to aspects of the invention, taken along line 6-6 in FIG. 4.

The first piece 52 can have a base body 56. The base body 56 can have any suitable cross-sectional shape. In one embodiment, the base body 56 can be configured for interlocking engagement with or to be otherwise retained within the cavity 26. For instance, the base body 56 can be generally dovetailed in cross-section, as is shown in FIG. 6. The base body 56 can have an inner surface 58, which can be generally planar. The term "inner" is intended to mean relative to the axis of rotation of the rotor when the first piece 52 is installed in its operational position.

The first piece 52 can also include a first finger 60 projecting from a portion of the base body 56, such as first side surface 62, and terminating at a first end 64. The first finger 60 can be substantially straight. The first finger 60 can extend at any suitable angle relative to the base body 56. For instance, the first finger 60 can extend at about 90 degrees relative to the first side surface 62. An opposite side surface 66 of the base body 56 can be configured for engagement with one or more components forming the cavity 26. In one embodiment, the opposite side surface 66 can be angled relative to the first side surface 62.

Figure 5:
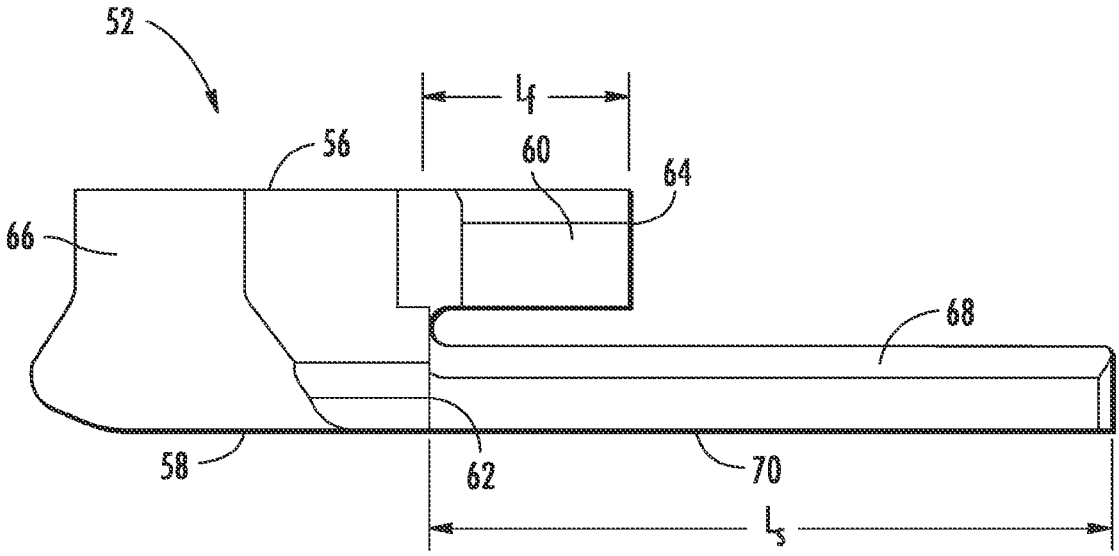
FIG. 5 is a side elevation view of a first piece of a closing key system according to aspects of the invention.

According to aspects of the invention, the first piece 52 can also have an elongated alignment plate 68 extending from the base body 56, such as from the first side surface 62. The alignment plate 68 can be substantially straight. The alignment plate 68 can extend at any suitable angle relative to the base body 56. For example, the alignment plate 68 can extend at about 90 degrees relative to the first side surface 62. The alignment plate 68 can be substantially parallel to the first finger 60. Referring to FIG. 5, the alignment plate 68 can be radially spaced from the first finger 60. For instance, the first finger 60 can be disposed at a higher radial elevation than the alignment plate 68. The terms "radial," "radially" and variants thereof are intended to mean relative to the axis of rotation of the rotor when the first piece is installed in its operational position. The alignment plate 68 can have an associated length $L_s$, and the first finger 60 can have an associated length $L_f$. The length of the alignment plate $L_s$ can be greater than the length of the first finger $L_f$. In one embodiment, the length of the alignment plate $L_s$ can be about two to about three times the length of the finger $L_f$.

While the term "plate" may connote a flat and/or rectangular structure, it will be understood that the alignment plate 68 is not limited to any particular configuration. Indeed, the alignment plate 68 can have any suitable geometry. For instance, the alignment plate 68 can have a cross-section that is substantially rectangular, substantially square, substantially semi-circular, substantially triangular, substantially polygonal, substantially trapezoidal, substantially semi-ovular, substantially T-shaped or substantially dovetail-shaped, just to name a few possibilities. The cross-sectional area of the alignment plate 68 can be substantially constant along its length $L_s$, or it can vary along at least a portion of the length of the alignment plate $L_s$. The alignment plate 68 can have a planar inner surface 70. The inner surface 70 of the alignment plate 68 can be substantially flush with the inner surface 58 of the base body 56.

The first key piece 52 can be made of any suitable material. In one embodiment, the first key piece 52 can be made of 304 stainless steel. The first key piece 52 can be made by any suitable manner. For instance, the first key piece 52 can be made by machining. The alignment plate 68 and the base body 56 of the first piece 52 can be a single piece construction. Alternatively, the alignment plate 68 can be made separately from the base body 56. In such case, the alignment plate 68 can be joined to the base body 56 in any suitable manner, such as by welding, mechanical engagement and/or adhesives.

Figure 7:
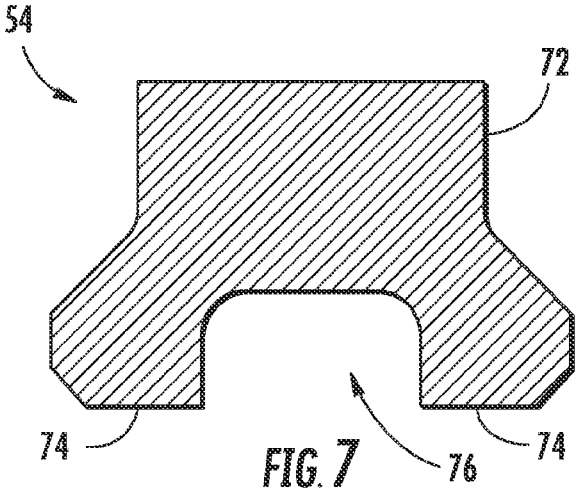
FIG. 7 is a cross-sectional view of a second piece of a closing key system according to aspects of the invention, taken along line 7-7 in FIG. 4 and showing a key slot extending therethrough.

The second key piece 54 can have a base body 72. The base body 72 can have any suitable cross-sectional shape. In one embodiment, the base body 72 can be configured for interlocking engagement with or to be otherwise retained within the cavity 26. For instance, the base body 72 can be generally dovetailed in cross-section, as is shown in FIG. 7. The base body 72 can have an inner surface 74, which can be generally planar. The term "inner" is intended to mean relative to the axis of rotation of the rotor when the second key piece 54 is installed in its operational position. A retaining tab 75 can extend from one side of the base body 72. The retaining tab 75 can be received in the notch 22 in a blade root 14.

According to aspects of the invention, the second key piece 54 can have a key slot 76 (see FIG. 7). The key slot 76 can open to the planar inner surface 74. In some embodiments, the key slot 76 does not open to the inner planar surface 74. The key slot 76 can have an open first longitudinal end 78 (see FIG. 8). In some instances, they key slot 76 can also have an open second longitudinal end 80 (see FIG. 8). The key slot 76 can be adapted to receive the alignment plate 68 of the first key piece 52. To that end, the key slot 76 can have a cross-section that substantially corresponds to the geometry of the alignment plate 68. For instance, the key slot 76 can be substantially rectangular, substantially square, substantially semi-circular, substantially triangular, substantially polygonal, substantially trapezoidal, substantially semi-ovular, substantially T-shaped or substantially dovetail-shaped, just to name a few possibilities. In one embodiment, the alignment plate 68 and the key slot 76 can be configured for substantial mating engagement.

The key slot 76 can be substantially straight. The cross-sectional area of the key slot 76 can be substantially constant along its length, or it can vary along at least a portion of the key slot 76. The alignment plate can be adapted to be received in the open front longitudinal end of the key slot and movable within the key slot in the longitudinal direction.

While the above description concerns a first key piece 52 with an alignment plate 68 and a second piece 54 with a key slot 76, it will be understood that, in some instances, it may be possible to reverse these features such that the first key piece 52 has a key slot 76 and the second key piece 54 has an alignment plate 68.

The second key piece 54 can also include a second finger 82 projecting from a portion of the base body 72, such as second side surface 84, and terminating at a second end 86 (see FIG. 4). The second finger 82 can be substantially straight. The second finger 82 can be substantially identical to the first finger 60. The second finger 82 can extend at any suitable angle relative to the base body 72. For instance, the second finger 82 can extend at about 90 degrees relative to the second side surface 84. The second finger 82 can be on the opposite side of the base body 72 from the retaining tab 75. The exact configuration of each of these features can be varied from application to application.

The second key piece 54 can be made of any suitable material. In one embodiment, the second key piece 54 can be made of 304 stainless steel. The second key piece 54 can be made as a single piece, such as by machining.

Figure 1:
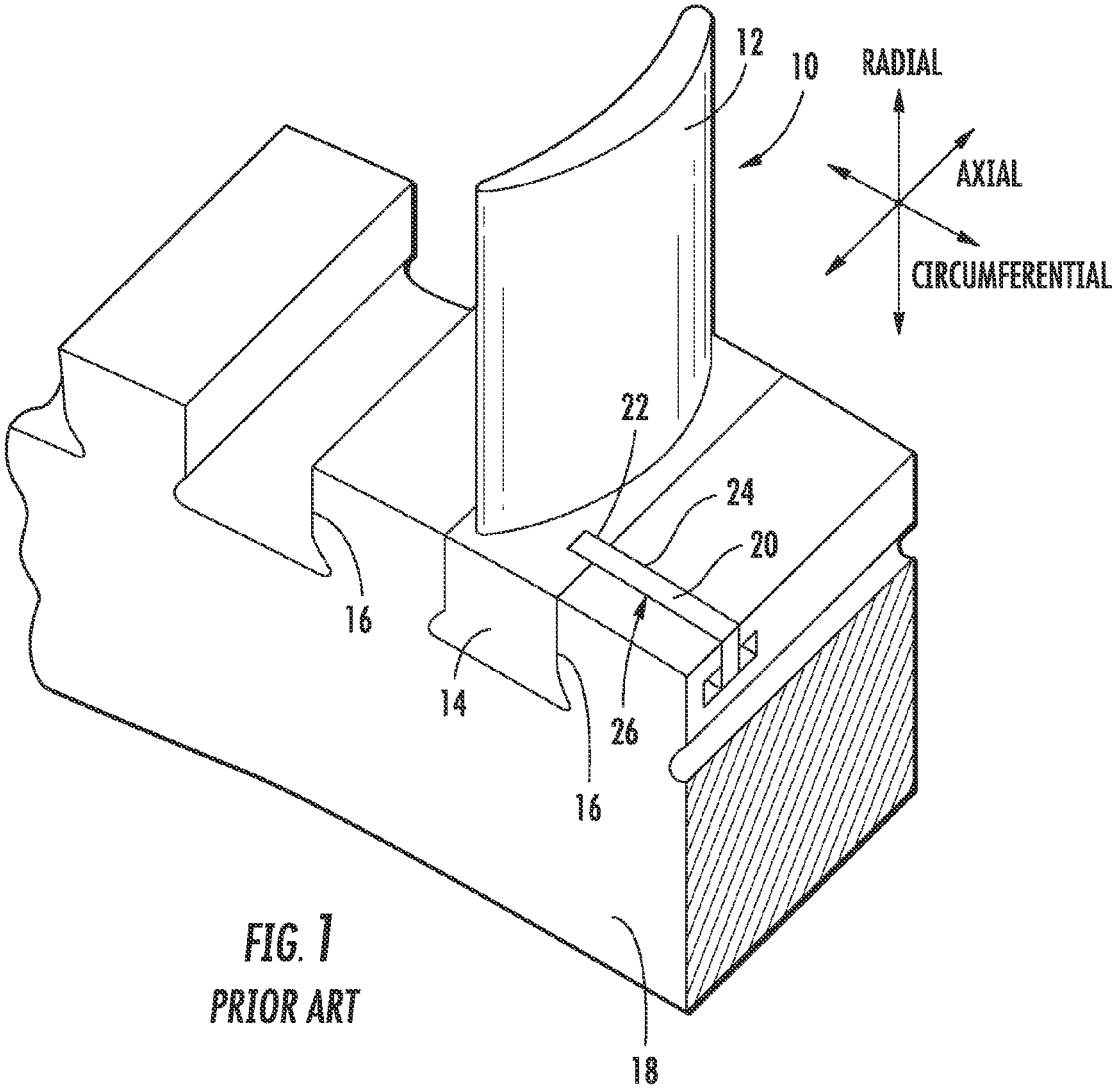
FIG. 1 PRIOR ART
FIG. 1 is a perspective view of a compressor blade mounted on a compressor disc and being axially restrained by a known closing key system.
Figure 2:
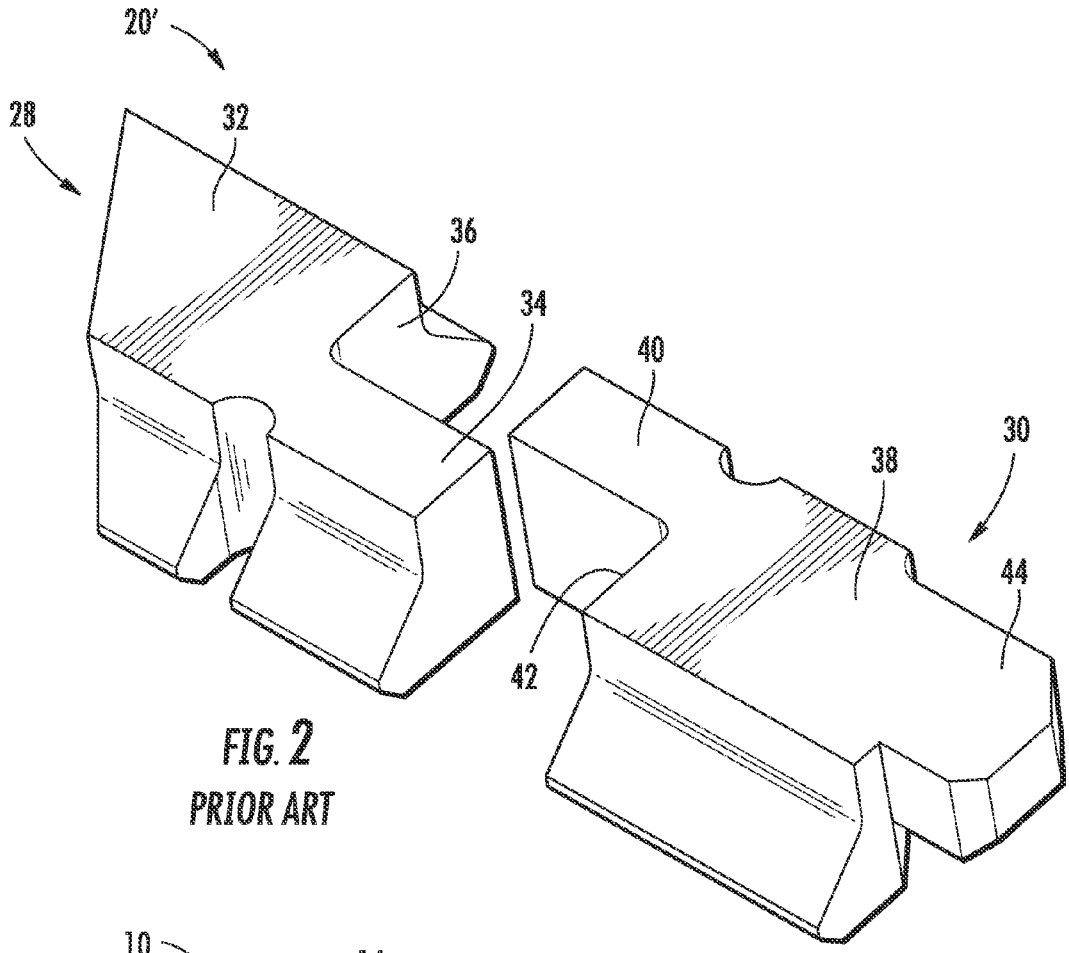
FIG. 2 PRIOR ART
FIG. 2 is a perspective view of a known two piece closing key system for a compressor blade.

Now that the individual components of the closing key system according to aspects of the invention have been described, an example of the assembly and operation of such components will be described. As noted above, previously used reference numbers for the compressor disc 18 and the blade 10 and their associated features, as used in connection with FIG. 1, will be used herein.

Figure 3:
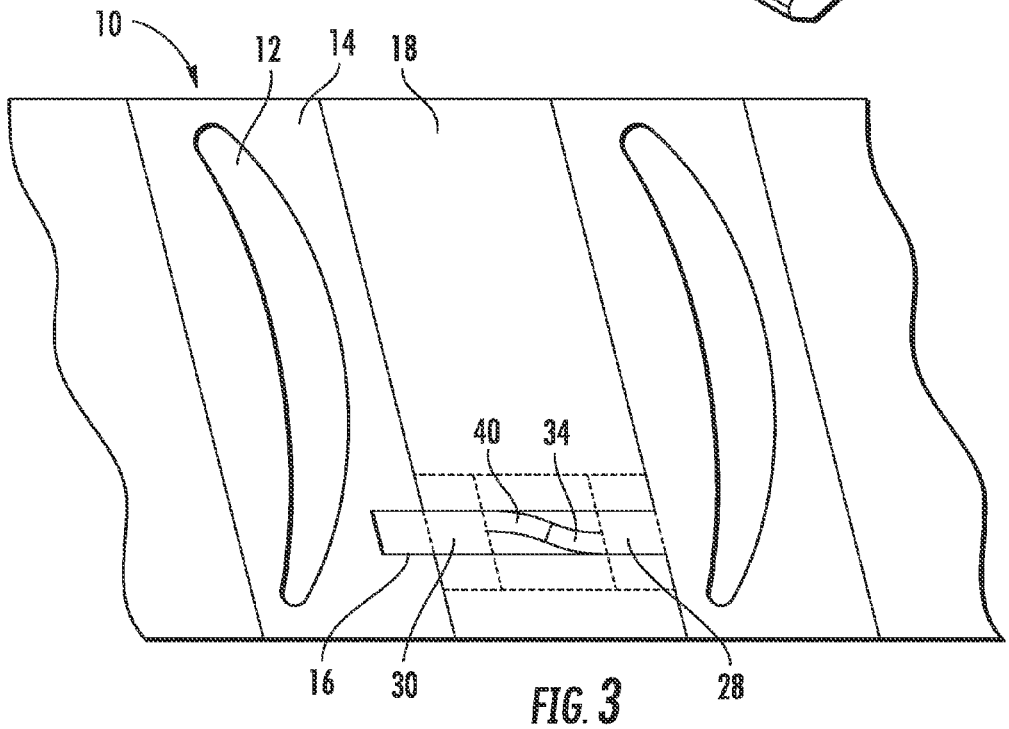
FIG. 3 PRIOR ART
FIG. 3 is a top plan view of a portion of a row of compressor blades, showing a known two piece closing key system in its operational position.
Figure 8:
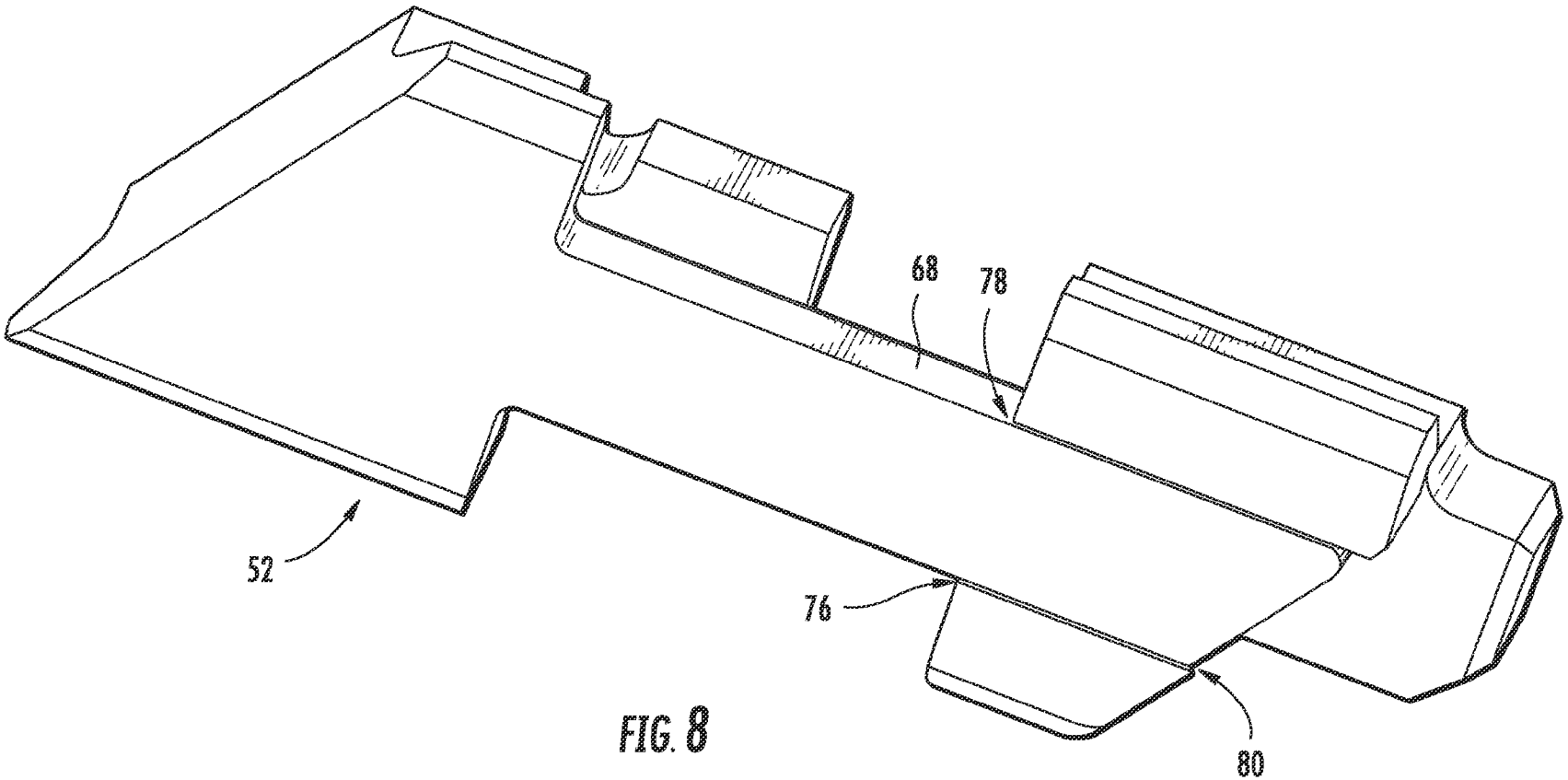
FIG. 8 is a bottom perspective view of a closing key system according to aspects of the invention, showing a protrusion from a first piece being slidably received in a key slot in the second piece.

To install the closing key 50 in the cavity 26, the first key piece 52 is initially inserted in the cavity 26 and then the second key piece 54. The alignment plate 68 of the first key piece 52 can be inserted into the key slot 76 in the second key piece 54, as shown in FIG. 8. Once in the cavity 26, the first and second key pieces 52, 54 can be brought together so that the end 64 of the first finger 60 substantially abuts the side surface 84 of the base body 72 of the second piece 54 and so that the end 86 of the second finger 82 substantially abuts the side surface 62 of the base body 56 of the first piece 52. In such case, the first and second fingers 60, 82 will be generally parallel to each other along their lengths. Further, in order to lock the blade 10, the first and second key pieces 52, 54 are moved away from each other such that the tab 75 of the second key piece 54 is moved in the notch 22 of the blade root 14 to lock the blade 10. The ends 64, 86 of the fingers 60, 82 are brought into operative engagement with each other. In doing so, the fingers 60, 82 bend, as is shown in FIG. 3. This expanded length of the closing key 50 is held fixed by the opposing bending forces exerted by each of the pieces 52, 54.

During engine operation, the engagement between the alignment plate 68 and the key slot 76 keeps the first and second key pieces 52, 54 aligned. The first and second key pieces 52, 54 can slide relative to each other along a predetermined and fixed path along the longitudinal centerlines of the two key pieces 52, 54. By keeping the first and second key pieces 52, 54 aligned, their respective fingers 60, 82 are kept in alignment and in engagement as well. Further, the alignment plate 68 can provide resistance against the bending of the fingers so that the first and second key pieces 52, 54 do not shift when the fingers 60, 82 are being bent, thereby allowing the fingers 60, 82 to be aligned properly when being bent into engagement. Because of this fixed alignment, it will be appreciated that the two key pieces 52, 54 are kept in constant alignment so that regardless of the width of either of the two key pieces 52, 54 or the width of the cavity 26, the key pieces 52, 54 will not disengage and become unlocked, minimizing the potential for the blade 10 to liberate during compressor operation.

From time to time, it may be necessary to replace the closing key system 50. The removal of the system 50 can be achieved by performing the above steps in reverse order. The opposing fingers 60, 82 can be unbent and disengaged and the two key pieces 52, 54 can be moved toward one another until they are at the point where they can be removed from the cavity 26.

The closing key system 50 according to aspects of the invention can provide numerous benefits. For instance, the closing key system 50 can improve the reliability of compressor closing keys by ensuring the engagement of the fingers 60, 82 regardless of machining tolerances of the cavity 26 and/or the first and second key pieces 60, 82, cocking of the first and second key pieces 60, 82, wear of the cavity 26 and/or the first and second pieces 60, 82, and corrosion of any of these components. As a result, the compressor blades 10 can be prevented from becoming liberated and causing significant damage to nearby compressor components.

Further, the closing key system can be readily handled by service personnel. A two piece closing key construction is maintained, which is easier to handle by service personnel, particularly those already familiar with the prior system. In addition, no training/retraining of service personnel is required and the same tooling can be used, since the parts fit together and the fingers are bent as was done in the prior closing key system.

The foregoing description is provided in the context of one possible application for a blade closing key system according to aspects of the invention. While the above description is made in the context of the compressor section of a turbine engine, it will be understood that the system according to aspects of the invention can be readily applied to rotor discs in the turbine section as well. In addition, the blade closing key system can be used in connection with each rotor disc in the compressor section or on less than all rotor discs. Thus, it will of course be understood that the invention is not limited to the specific details described herein, which are given by way of example only, and that various modifications and alterations are possible within the scope of the invention as defined in the following claims.

What is claimed is:

1. A blade closing key system comprising: a first key piece having a base body with a bendable first straight finger protruding from a first side surface thereof, the first finger having a first end, the first key piece further including an alignment plate extending from the first side surface, wherein the alignment plate is spaced from the first finger; and a second key piece having a base body with a bendable second straight finger protruding from a first side surface thereof, the second finger having a second end, the second key piece further including a key slot sized to receive the alignment plate, the key slot having an open first longitudinal end, the first and second key pieces being positioned such that at least a portion of the alignment plate is received in the open first longitudinal end of the key slot and such that first and second fingers are opposed in bending with the first and second ends engaging each other, whereby the engagement between the alignment plate and the key slot keeps the first and second key pieces aligned and the first and second fingers engaged.

2. The system of claim 1 wherein the key slot includes an open second longitudinal end.

3. The system of claim 1 wherein the alignment plate is substantially straight.

4. The system of claim 1 wherein the alignment plate has an associated length and the first finger has an associated length, wherein the length of the alignment plate is greater than the length of the first finger.

5. The system of claim 1 wherein the alignment plate has an associated length and the first finger has an associated length, wherein the length of the alignment plate is about two to about three times greater than the length of the first finger.

6. The system of claim 1 wherein the first finger and the alignment plate are substantially parallel.

7. The system of claim 1 wherein at least one of the first finger and the alignment plate extend from the first side surface at about 90 degrees.

8. The system of claim 1 wherein the alignment plate is disposed at a lower radial elevation than the first finger.

9. The system of claim 1 wherein the alignment plate has an inner surface and wherein the base body of the first key piece has an inner surface, wherein the inner surface of the alignment plate is substantially flush with inner surface of the base body of the first key piece.

10. The system of claim 1 wherein the key slot opens to an inner surface of the base body of the second key piece.

11. The system of claim 1 wherein the alignment plate and the key slot are in substantially mating engagement.

12. The system of claim 1 wherein the alignment plate has an inner surface and wherein the base body of the second key piece has an inner surface, wherein the inner surface of the alignment plate is substantially flush with inner surface of the base body of the second key piece.

13. A blade closing key system comprising: a blade having an airfoil and a root, the root having a notch therein; a rotor disc having a circumferentially extending slot therein, the rotor disc having and a groove configured to receive a root portion of a blade, wherein the root of the blade is received in the groove so as to attach the blade to the disc and so as to restrain movement of the blade in radial and circumferential directions relative to an axis of rotation of the rotor disc, wherein the notch in the blade is substantially aligned with the slot in the disc to collectively define a cavity; and a closing key received in the cavity, wherein the closing key restrains movement of the blade in the axial direction, the closing key including: a first key piece having a base body with a bendable first straight finger protruding from a first side surface thereof, the first finger having a first end, the first key piece further including an alignment plate extending from the first side surface, wherein the alignment plate is spaced from the first finger; and a second key piece having a base body with a bendable second straight finger protruding from a first side surface thereof, the second finger having a second end, the second key piece further including a key slot sized to receive the alignment plate, the key slot having an open first longitudinal end, the first and second key pieces being positioned such that at least a portion of the alignment plate is received in the open first end of the key slot and such that first and second fingers are opposed in bending with the first and second ends engaging each other, whereby the engagement between the alignment plate and the key slot keeps the first and second key pieces aligned and the first and second fingers engaged.

14. The system of claim 13 wherein the rotor disc is a compressor rotor disc.

15. The system of claim 13 wherein the alignment plate has an associated length and the first finger has an associated length, wherein the length of the alignment plate is greater than the length of the first finger.

16. The system of claim 13 wherein the first finger and the alignment plate are substantially parallel.

17. The system of claim 13 wherein the alignment plate has an inner surface and wherein the base body of the first key piece has an inner surface, wherein the inner surface of the alignment plate is substantially flush with inner surface of the base body of the first key piece.

18. The system of claim 13 wherein the key slot opens to the inner surface of the base body of the second key piece.

19. The system of claim 13 wherein the alignment plate and the key slot are in substantially mating engagement.

20. The system of claim 13 wherein the key slot includes an open second longitudinal end.

* * * * *